US008435622B2

(12) United States Patent
Papadopoulos et al.

(10) Patent No.: US 8,435,622 B2
(45) Date of Patent: May 7, 2013

(54) PACKAGING FILM

(75) Inventors: Georgios Papadopoulos, Crete (GR); Anthony G. Karandinos, Crete (GR); Damianos Markakis, Crete (GR); Emmanouil Grevetzakis, Crete (GR); Sofia Parouti, Thessaloniki (GR)

(73) Assignee: Megaplast S.A. Packaging Materials Industry, Attica (GR)

( * ) Notice: Subject to any disclaimer, the term of this patent is extended or adjusted under 35 U.S.C. 154(b) by 1264 days.

(21) Appl. No.: 12/083,999

(22) PCT Filed: Jan. 13, 2006

(86) PCT No.: PCT/EP2006/000275

§ 371 (c)(1),
(2), (4) Date: Apr. 23, 2008

(87) PCT Pub. No.: WO2007/079776

PCT Pub. Date: Jul. 19, 2007

(65) Prior Publication Data

US 2009/0047468 A1 Feb. 19, 2009

(51) Int. Cl.
*B32B 3/04* (2006.01)
*B32B 3/10* (2006.01)

(52) U.S. Cl.
USPC ..... 428/131; 428/77; 428/121; 428/134; 428/137; 428/156; 428/192; 428/219; 428/220; 428/500

(58) Field of Classification Search ..... None
See application file for complete search history.

(56) References Cited

U.S. PATENT DOCUMENTS

| | | | | |
|---|---|---|---|---|
| 4,235,062 | A | 11/1980 | Lancaster, III et al. | |
| 4,754,594 | A | 7/1988 | Lancaster | |
| 2005/0118391 | A1 * | 6/2005 | Kavvadias et al. | 428/131 |
| 2005/0123721 | A1 * | 6/2005 | Heikaus et al. | 428/137 |

FOREIGN PATENT DOCUMENTS

| | | |
|---|---|---|
| DE | 102 01 480 | 7/2003 |
| EP | 0 300 855 | 12/1991 |
| EP | 0 816 056 | 1/1998 |
| EP | 0 820 856 | 1/1998 |
| EP | 0 909 721 | 4/1999 |
| EP | 0 999 037 | 5/2000 |
| WO | WO 01/60709 | 8/2001 |
| WO | WO 02/094674 | 11/2002 |
| WO | WO 2004/022634 | 3/2004 |
| WO | WO 2004/080695 | 9/2004 |
| WO | WO 2005/087608 | 9/2005 |
| WO | WO 2006/018028 | 2/2006 |

* cited by examiner

*Primary Examiner* — David Sample
*Assistant Examiner* — Jeff Vonch
(74) *Attorney, Agent, or Firm* — Andrus, Sceales, Starke & Sawall, LLP

(57) ABSTRACT

A packaging film with a main film made of a stretchable polymer film material and having a multiplicity of holes. A first condition of the main film including that a ratio of aeration percentage over final weight is greater than or equal to 14 meters per gram. A second condition of the main film is that the width of the packaging film is reducible by less than 15% between a condition before any stretching of the packaging film and a condition when the packaging film is stretched at an elongation equal to the elongation at the NDR point. A third condition of the main film is that a ratio of an absolute value of the difference of a holding force of the packaging film minus a predetermined target holding force divided by the target holding force is less than or equal to 5%.

67 Claims, 11 Drawing Sheets

PACKAGING FILM

CROSS-REFERENCE TO RELATED APPLICATIONS

This application is a National Stage application of International Application No. PCT/EP2006/000275, filed on Jan. 13, 2006, which is incorporated herein by reference in its entirety.

BACKGROUND OF THE INVENTION

1. Field of the Invention

The present invention relates to a packaging film made of a stretchable polymer film material and having a multiplicity of holes on the main film.

2. Description of the Prior Art

For packing or wrapping goods stacked on a pallet, bales of straw, fruit, trolleys of pots of plants etc., it is known that perforated plastic stretch films are used in order to provide sufficient holding force and stretchability of the packaging film as well as ventilation of the products to be packed. Known from EP 0 820 856 A1 is a pre-stretched plastic stretch film in which holes are formed by a thermal irradiation method without contacting the film and thus without waste of film material, for example, caused by punching out holes.

Known from EP 0 909 721 A1 is a perforated extensible palletizing film comprising a longitudinally elongated thin sheet of extensible plastics provided with ventilation holes and longitudinal reinforcement elements which are made of extensible plastics and are adapted to increase the strength of the film in the pulling direction.

Similar perforated stretch films are known from DE 102 01 480 A1, WO 01/60709 A1 and WO 02/094674 A1.

The perforations of these stretch films represent a macro perforation in which holes having a diameter of at least 5 mm are provided in a base film. Films with significantly smaller perforations represent a micro perforation and are irrelevant to the present invention.

The above should not be confused with film products on which slits or small punctures have been made initially with the intention that these increase, break or open (resulting in large openings) as a result of the film being stretched during usage e.g. in a wrapping machine with a pre-stretching system.

A wrapping machine with a film pre-stretching system will pre-stretch the film prior to wrapping it on a pallet load by a pre-stretch ratio e.g. between 100 to 300%. Pre-stretching the film by 100% means that an initial length of 1 meter becomes 2 meters after stretching, i.e. a length increase of 100%. The stretching direction coincides with the main or longitudinal direction of the film. Alternatively, a packaging film may be provided already stretched to the length to be used by the end-user (i.e. stretched during the production or conversion process). In this case a wrapping machine without a pre-stretching system may be employed or, simply, the film may be applied to the load manually.

In both cases, partial or total failure (breakage) of the packaging film is undesirable.

In practice, a number of problems may arise in connection with the above-described macro-perforated stretch films comprising reinforcing elements or having no reinforcing elements. Namely, the stretch films are normally used by automatic or semi-automatic stretch wrapping machines, in order to wrap products stacked on pallets. As mentioned earlier, to ensure good material utilization, it is desirable to stretch the stretch film before or during the wrapping operation. To this end, considerable force is required to stretch the film which can be significantly increased by reinforcing elements fixed onto the stretch film. Under special conditions, a wrapping machine is no longer capable of providing sufficient stretching of the stretch film for lack of sufficient power.

On the other hand, if the wrapping machine is strong enough to provide the desired stretching, there is the danger that the forces acting on the products to be wrapped are too great. If the products are, for example, boxes, there is the risk that the stretch film and/or the reinforcing elements fixed thereto, press the products or their packages together and damage them.

SUMMARY OF THE INVENTION

It is the object of the present invention to provide a packaging film in which a control of the product variables, in particular with respect to strength and stretchability is achieved, with optimal material utilization. In this connection it is not important to obtain very high strength or holding force but rather to achieve reliably the targeted values with a minimum of material involved.

Moreover, it is the object of this invention to provide a packaging film which is compatible with existing wrapping machines and has a structure which minimises the risk of partial or total failure of the film during production as well as during the pallet wrapping operation (i.e. usage).

The accomplishment of the object of the present invention is set forth by a packaging film made of a stretchable polymer film material and a multiplicity of holes on the main film.

To reduce material cost and waste volume, a packaging film should utilize as little mass (i.e. weight) per meter as possible. Therefore, a packaging film of a given initial weight per meter should be able to be stretched to an elongation as high as possible. It should therefore be able to be pre-stretched to a high degree without failure. A higher elongation means that a film of a smaller final weight per meter will be wrapped around the pallet or other load.

In theory, the elongation at the Break Point (B), as measured by a typical tensile stress-strain curve like that of FIG. 16, is a measure of the maximum obtainable elongation. However, it has been found that in practice a better, more realistic measure of maximum elongation for the application of a packaging film is the elongation at the so-called Natural Draw Ratio point (N), hereafter referred to as the NDR point.

A curve like that of FIG. 16 is obtained by pulling the packaging film along the main pulling direction (longitudinal direction) of the film. Many extensometers (tensile testers) are available in the market and can be used to obtain such curves. The NDR point can be found by drawing two tangent lines to the almost linear part of the yield plateau and strain hardening regions of a stress-strain curve. The point in which a vertical line that passes through the intersection of the two tangent lines meets the stress-strain curve is defined as the NDR point. The elongation at the NDR point is a good measure of the maximum elongation of the packaging film. The tensile force at the NDR point correlates well with the holding force that the packaging film can exert when wrapped around a load. A more detailed discussion of the NDR point can be found in WO 2004/022634.

Further requirements for an optimum packaging film are: A packaging film should utilize as little weight (i.e. mass) per meter of product as possible. The packaging film should further have as high width as possible but not greater than the nominal (standard) width of the wrapping equipment (wrapping machine) employed. A packaging film should have good mechanical properties in the transverse direction TD, i.e. the direction perpendicular to the main pulling direction MD, so that it maintains a substantial network-like structure when stretched. This will allow the packaging film to wrap well and not break around uneven surfaces such as the pallet corners and the load corners. Thus, load stability is further enhanced and better distribution of forces is achieved. Therefore, tension is not only concentrated in an area of the reinforcement elements, if any, but is more evenly distributed along the structure. A packaging film for applications that need to "breathe" should have a pre-specified percentage of aeration. It should not break uncontrollably. A packaging film should have adequate but not excess holding force and stiffness.

All the above requirements should hold simultaneously for an optimized perforated stretch wrap film. A packaging film according to the invention fulfills these requirements so that an improved perforated stretch wrap film can be provided.

According to a feature of the preferred embodiment, a packaging film comprising a main film made of a stretchable polymer film material and comprising a multiplicity of holes on the main film is defined by a combination of four formulas.

The first formula intends to maximize aeration while at the same time keeping a low final weight of the packaging film per meter. Aeration and weight per meter should be evaluated at the application elongation of the film, i.e. the elongation at which the film is intended for use. More particularly, when comparing two films, the maximum application elongation should be considered.

The first formula defines a ratio of aeration percentage over final weight which should be greater than or equal to 14 meters per gram:

$$\frac{[\text{Aeration percentage}](\%)}{[\text{Final weight}](\text{gr/m})} \geq 14\,\text{m/gr} \tag{1}$$

Every parameter's name is closed in square brackets, e.g. [weight], to make clear that it is not just text but it is the descriptive name of a parameter. After each parameter the default unit is mentioned in brackets, e.g. [weight] (gr) means that weight is a parameter that is measured and reported in grams. If the unit is (%) then the parameter does not have units (i.e. it is a plain number) but it is the percentage of a variable divided by some other variable (such as a relative difference expressed in percent).

It is necessary that the aeration percentage is calculated for a predetermined, adequate length over which a good estimate of the overall aeration percentage can be obtained. A typical length can be, e.g. 2 meters. A very short length will obviously lead to incorrect results. The aeration percentage is measured with the packaging film pre-stretched at a pre-stretch ratio equal to the maximum application elongation of the packaging film. The maximum application elongation for a packaging film is considered to be the elongation at the NDR point.

The parameter "final weight" is simply the weight per meter of the packaging film when the film is pre-stretched at an elongation equal to the elongation at the NDR point. It is given by the following formula:

$$[\text{final weight}](\text{gr/m}) = \frac{[\text{initial weight per meter}](\text{gr/m})}{((100 + [\text{elongation at } NDR \text{ point}](\%))/100)}$$

Final and initial weight is measured in grams per meter length. The number 100 must be added to the elongation at the NDR point because an elongation of, e.g. 200%, means that one initial meter of film becomes 3 meters. Therefore, if initially one meter of film weighs e.g. 15 grams, after stretching at 200% ratio, one meter will weigh 15/3=5 grams.

The second formula to be fulfilled by the packaging film according to the invention is $$\frac{(\text{initial width} - \text{final width})}{\text{initial width}} * 100(\%) \leq 15\% \tag{2}$$

Initial width is the average (typical) width before any stretching and final width is the width when the product is stretched at the maximum application elongation. Obviously, both, initial width and final width of the product should be expressed in the same units (e.g. cm). This expression is necessary because it guarantees that the stretching takes place in a way that the width does not reduce uncontrollably.

This means that the width of the packaging film is reducible by less than 15% between a condition before any stretching of the packaging film and a condition when the packaging film is stretched at a maximum application elongation given by the elongation at the NDR point.

The third formula is specified as $$\frac{|[\text{Desirable holding force}] - [\text{holding force}]|(N)}{[\text{Desirable holding force}](N)} * 100 \leq 5\% \tag{3}$$

Holding force is the holding force of the packaging film (in Newtons) measured as the force at the NDR point. Desirable holding force is a target holding force (in Newtons) that depends on the type of application, the target market, the type of wrapping machine, etc. The actual holding force that a packaging film exerts on a pallet load will depend on many other unforeseen factors (such as usage, application, etc.) and will most probably have a different value than the force at the NDR point. However, the force at the NDR point is a convenient quantity that will reliably estimate holding force performance of a packaging film.

For a particular packaging film the value of the target holding force will depend on the width of the film. For example, if a packaging film of around 50 cm should have a target holding force of e.g. 200 N, an equivalent packaging film whose width is 75 cm (i.e. 50% more width) should have a target holding force of 300 N.

For packaging films intended to be used with wrapping machines designed for 50 cm (20 inch) wide stretch film, or, in general, for packaging films whose width is between about 40 and 55 cm, the target holding force may be between 250 and 70 Newtons, particularly between 210 and 100 Newtons, particularly between 190 and 150 Newtons.

For packaging films intended to be used with wrapping machines designed for 75 cm (30 inch) wide stretch film, or, in general, for packaging films whose width is between about 55 and 80 cm, the target holding force may be between 380 and 100 Newtons, particularly between 315 and 150 Newtons, particularly between 285 and 220 Newtons.

The fourth formula concerns the performance of the packaging film in the transverse direction:

$$\frac{[\text{Elongation at break } TD]\%}{[\text{Elongation at } NDR \text{ point}](\%)} * 100 \geq 50\% \tag{4}$$

The elongation at break TD is the elongation at break of the tensile stress-strain curve of the film but measured along the transverse (perpendicular to the main) direction (TD). This condition means that the film will have good performance in the corners of a pallet or around uneven objects and loads.

According to an embodiment of the invention, the holes on the main film are arranged in at least one column along a main direction of the film. The holes may be arranged on the main film in at least three substantially parallel columns along the main direction.

According to an embodiment of the invention, at least one reinforcement element is arranged and fixed on the main film along the main direction. The reinforcement element may be according to a preferred embodiment a reinforcement strip made of a stretchable polymer film material.

The reinforcement strip may be fixed on the main film in an area between two adjacent columns of holes.

The reinforcement element is running uninterruptible and continuously along the main, longitudinal direction MD so that the packaging film is reinforced along its entire length.

According to an embodiment of the invention, two reinforcement strips are fixed on the main film in an area between two adjacent columns of holes.

In a packaging film according to the invention, there is therefore provided a main film made of a stretchable polymer film material (e.g. linear low density poly-ethylene LLDPE, copolymers thereof, multi-layered coextruded films thereof) in which a multiplicity of holes are arranged in several columns along a main direction.

If at least two longitudinal reinforcement elements are arranged and fixed on the main film in an area between two adjacent columns of holes, according to an embodiment at least a part of a surface of each reinforcement element is in direct contact with the main film.

In certain cases it may be preferable that two reinforcement elements are arranged between all pairs of adjacent columns of holes. However, in certain applications it may be possible to remove some reinforcement elements without significant deterioration of the desirable product performance. For example, the reinforcement element may be arranged between every second pair of adjacent columns of holes, or only between columns of holes closer to the edges of the film. It is also possible that only one or a selected, small number of columns of holes are protected in this way, owing to the specific requirements of a particular application. For example, in a pallet wrapping application, it is particularly desirable to reinforce the film against tearing near the bottom edge of the film, because that region of the film usually wraps against a corner of the pallet itself in the beginning of the wrapping process.

Therefore, according to the invention, there are at least two reinforcement elements (reinforcement strips) which are arranged between the same two adjacent columns of holes. Each of the reinforcement elements is in contact with the main film, thus contributing to the overall strength of the packaging film. The contact between the reinforcement elements and the main film is a so-called surface-to-surface contact.

Because a multiplicity of reinforcement elements is utilized, these elements can be placed on "strategic" locations on the main film, i.e. close to areas where the probability is high that a defect may occur during usage of the packaging film. This has the advantage that, although less material is utilized, a very good performance can still be guaranteed for the products. The reinforcing material can be placed selectively only where it is needed. For example, the reinforcement elements can be placed close to the holes (perforations) of the main film, so that the propagation of a tear may be stopped as soon as possible. This will lead to a packaging film with superior mechanical properties, low weight per meter and a pallet with better appearance as less material of the main film will be rendered useless. Moreover, because there are at least two distinct areas between two adjacent columns of holes, in which there is a contact between the main film and the corresponding reinforcement elements, there is a greater probability that a propagating tear will stop.

Another advantage of this structure is that the packaging film may have a more even distribution of thickness (i.e. thickness profile on a cross-section taken along the film width) as compared to a film with one reinforcement element with the same material utilization. A packaging film with a more even distribution of thickness is more compatible with certain existing types of automatic or semi-automatic wrapping machines equipped with a heat seaming system, which seams the end of the film on the pallet by heating it up. Moreover, if the film does not have very high thickness regions it will cause less damage on the surfaces of the rolls of the wrapping machine (e.g. the rolls of a pre-stretching system on which relatively high forces may act).

According to a variant of the invention, the reinforcement elements are reinforcement strips of a stretchable polymer material, preferably of a stretchable polymer film material. Reinforcement strips made of such a film material may be extremely thin, thus improving the material utilization.

At least one edge of at least one of the reinforcement strips may be hemmed, bunched or folded at least once longitudinally. This hemming or folding of the lateral edges of the reinforcement strip ensures additional reinforcement to prevent tearing at the edges.

In another variant of the invention one or more of the reinforcement elements comprise one or more strips of stretchable polymer material which partly or totally overlap with each other.

In yet another variant, at least one of the reinforcement elements comprises a strip of stretchable polymer material which is folded around a second strip of stretchable polymer material, along the longitudinal direction, such that the first strip totally surrounds the second one. At least two such reinforcement elements are placed between two adjacent columns of holes and at least a part of their surface is in direct contact with the main film.

It is advantageous if between each two adjacent columns of holes, where not at least two reinforcement elements are arranged, at least one reinforcement element is arranged. This means that there may be areas between two adjacent columns of holes where two or more reinforcement elements are provided, whereas there may be other areas where only one reinforcement element is arranged. This allows for example that in areas closer to the lateral edges of the main film, two or more reinforcement elements may be arranged between two adjacent columns of holes, whereas in the middle part of the main film, only one reinforcement element may be sufficient.

Moreover, only one reinforcement element may be needed to protect the lateral edges of the main film. For additional reinforcement the lateral edge of the main film may be hemmed, bunched or folded, with or without the corresponding reinforcement elements. Of course, it is also possible that the lateral edges of the film are protected by two reinforcement elements similar to the ones found between two adjacent columns of holes.

The reinforcement elements may be arranged on the same side of the main film. This allows a very effective and easy manufacturing process.

However, according to another embodiment of the invention, the reinforcement elements between two adjacent columns of holes are arranged such that at least one of these reinforcement elements is arranged on another side of the main film than the other reinforcement elements. Therefore, by arranging reinforcement elements on both opposing sides of the main film, the strength of the product may be additionally increased. According to a further advantageous development of the invention, the reinforcement elements between two adjacent columns of holes are not in direct contact with each other. This allows a very good material utilization.

Contrary to that, according to another embodiment of the invention, the reinforcement elements between two adjacent columns of holes are partly overlapping each other. This allows a particular increase of strength because in the overlapping area at least two reinforcement elements are effective for avoiding propagation of a tear in the main film.

Exactly two reinforcement elements may be arranged between two adjacent columns of holes. It has turned out that the provision of two reinforcement elements allows a good compromise between effort for manufacturing and improvement of the product abilities.

According to a further embodiment of the invention, one of the reinforcement elements between two adjacent columns of holes is completely overlapping the other reinforcement element. This usually requires that the one reinforcement element has other (greater) dimensions (e.g. width) than the other (smaller) reinforcement element.

The lateral edges of the reinforcement element which is completely overlapping the other reinforcement element may be folded such that the folded edges are partly surrounding the other reinforcement element. In this embodiment the other reinforcement element has the function of additionally increasing the strength of the greater overlapping reinforcement element.

The reinforcement elements may be flat and are fixed to the main film substantially smooth without any wrinkles. This close contact between the main film and the reinforcement strips allows an exchange of forces, particularly shear forces, so that the reinforcement elements can fulfil their intended function.

According to an embodiment both lateral edges of at least one of the reinforcement strips are folded inwardly, which reinforcement strip is arranged on the main film such that the folded lateral edges are in contact with the main film. The folding of the lateral edges increases the strength and resistance to tearing of the reinforcement strip. By bringing the folded part of the reinforcement strip in contact with the main film, the overall appearance of the packaging film is improved. Further, the risk can be reduced that at least a part of the reinforcement strip can detach from the main film.

According to yet another embodiment, both lateral edges of at least one of the reinforcement elements are folded at least once such that they overlap with one another, thus creating a longitudinal region of the reinforcement strip that has three or more times the original thickness of the reinforcement strip. The width of this region may vary depending on the original width of the reinforcement strip, the width of the folded lateral edges, and the times the edges are folded. The region of multiple (e.g. triple) thickness provides for an additional localised reinforcement of the product.

The width of a reinforcement element may be suitably small, e.g. less than 10 mm or less than 6 mm. The reinforcement elements may or may not have equal width. One or two such reinforcement elements can easily fit in between two columns of holes. It may be desirable that the distance between two adjacent columns of holes is not too small, e.g. it is at least 100 mm from one edge to an adjacent edge in the adjacent column. If this distance is too small the packaging film may resemble a fishing net. Such a structure has the undesirable property of getting easily tangled in forklifts and other machinery and it is awkward to handle after its removal from the pallet.

The holes may be formed by a thermal irradiation method without contacting the main film. EP 0 820 856 A1 describes that by a thermal irradiation method in which a hole is formed without contacting the film, each hole is surrounded by a bulge in the form of a lip. The lip results from a material accumulation by accumulated polymer material of the main film. The lip of the main film has a thickness greater than that of the other areas of the main film, as a result of material of the main film having accumulated around the hole. Only by stretching after formation of the holes can the accumulated material be reduced again, because some material may flow in the more strongly stretched regions in the vicinity of the lip. The lip thus causes an intended reinforcement of the film in the region of the hole so that the reinforcement elements should be arranged such that they are not in contact with the lips surrounding the holes or with edges of the hole. Such a contact or an overlap of the lips by the reinforcement elements may possibly not provide any additional advantages. Moreover, it may be difficult to place the reinforcement element on the lip so that a good contact thereof is provided, because the surface of the main film in the neighbourhood of the lip may not have an even thickness.

In a perforated film there is a greater chance that an imperfection or defect will occur around or near the periphery of the holes. Therefore, to stop tearing propagation as early as possible, it is advantageous if the reinforcement elements are placed as close to the edge of the holes as possible.

In particular, it is advantageous if the reinforcement elements are arranged such that a distance between an edge of each reinforcement element and an adjacent lip is as small as possible. The reinforcement elements should be arranged such that they extend as far as the lips without contacting them.

According to a further advantageous development of the invention, the columns of holes are staggered with respect to the main direction such that a center of one hole in one column is on a different line transverse to the main direction than the centers of adjacent holes in the immediately adjacent columns. By distributing the arrangement of holes in the main film in the above described way, the material properties can be improved.

One or two reinforcement elements may be fixed on the main film in an area between an outermost column of holes and a corresponding edge of the main film. This provides for a stabilization of the edge of the main film.

It can be advantageous if a distance of the closest-most edge of the reinforcement element from an adjacent edge of a hole or a lip of a hole is as small as possible. The lip of a hole is an area of increased thickness that surrounds a hole, particularly a hole generated by a thermal irradiation method without contacting the film.

The distance between the reinforcement element and the lip or edge of a hole can be smaller than 5 mm, particularly smaller than 3 mm, and even more particularly smaller than 1 mm.

According to an embodiment of the invention, the thickness of the reinforcement strip is greater than or equal to twice the thickness of the main film. The thickness of the reinforcement strip may therefore be greater than three times the thickness of the main film.

In order to achieve optimum interaction between the main film and the reinforcement element, the reinforcement strip should be applied as smoothly as possible without producing wrinkles on the main film and/or the reinforcement strip itself.

For improving adhesion of the reinforcement strip at the main film, the reinforcement strip and/or the main film may be heated before attaching the former on the latter.

Moreover, many other methods known in the art can be used to augment adhesion, such as the application of pressure, lamination, processing a surface of a film with a surface treatment process (e.g. corona treatment, flame treatment, plasma treatment) or use of adhesive substances. Such methods can be used in combination or independently of one another.

The packaging film preferably may be used for wrapping a load formed by goods stacked on a pallet or a trolley or another form of load with the aid of a wrapping machine with or without a pre-stretching system or by manual application of the film to the load.

This and other features of the invention are explained in detail below in examples with reference to the appended drawings.

BRIEF DESCRIPTION OF THE DRAWINGS

FIG. 1(*b*) is an enlarged cross-section through the stretch film of FIG. 1*a;*

FIG. 14(*b*) a cross-section of the stretch film of FIG. 14(*a*);

FIG. 15(*b*) a cross-section of the stretch film of FIG. 15(*a*); and

DETAILED DESCRIPTION OF THE INVENTION

In all drawings of cross-sections the thickness is shown out of proportion compared to the width of the film for illustration purposes.

Certain of the above Figures depict embodiments with two reinforcement elements between a pair of adjacent columns of holes. However, this fact should not be viewed as limiting the generality of the invention as defined in the claims.

Figure 1A:
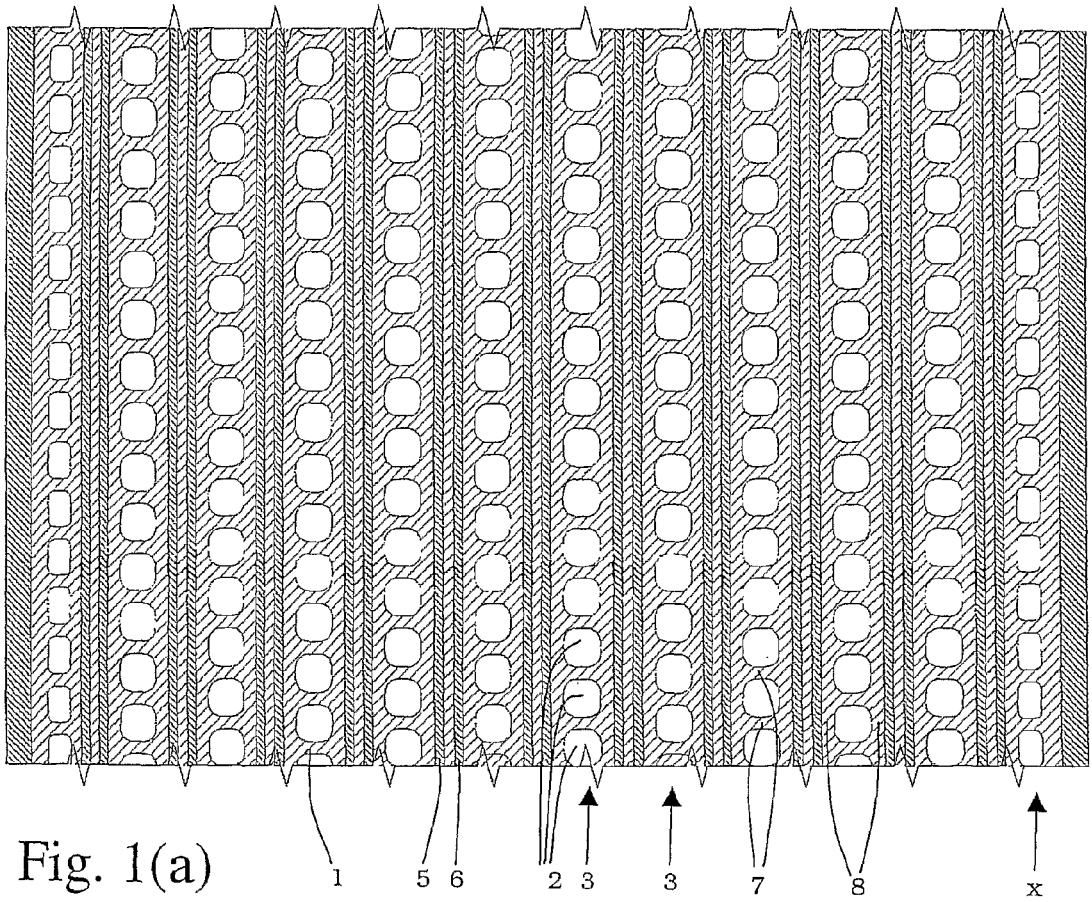
FIG. 1(*a*) is a top view of a portion of the packaging film according to a first embodiment of the invention in an unstretched or slightly stretched state.

FIGS. 1(*a*) and 1(*b*) show a packaging film of the invention in an unstretched or slightly stretched state (e.g. 0-25% stretching ratio).

In a main film 1 made of a stretchable film material (e.g. LLDPE), there are formed a multiplicity of holes 2 in the form of several substantially parallel columns 3 of holes 2 extending in a main direction X (MD), for example with the aid of the method described in EP 0 820 856 A1. The main film 1 is of great length and may be wound on and off in the direction X.

According to the process of manufacture of the holes 2 as described in EP 0 820 856 A1, after thermal treatment, bulges referred to as lips 4 form which surround each hole 2 with a thickness greater than the thickness of the base film 1 (not shown in the Figs.) at least prior to further stretching. The lip 4 allows stronger stretching of the film around the hole 2 without the formation of tears at the edge of the hole 2. The lip 4 rather forms a material stock so that plastic material may flow from the lip 4 into adjacent regions in which, due to stretching, increased tensions appear. These tensions are alleviated by the flow of material from the lip 4 to the adjacent regions, thus allowing the perforated plastic film to stretch without breaking.

Figure 1B:
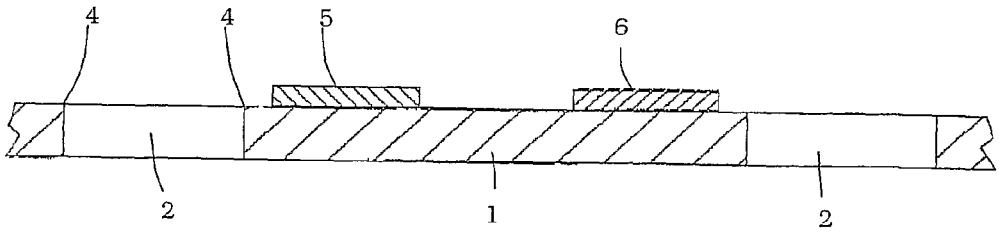

Fixed on the main film 1 between two adjacent columns 3 of holes 2 are two reinforcement strips 5, 6. The reinforcement strips 5, 6 are also made of stretch film material such as LLDPE. They extend in the direction of the main direction X. They are arranged side by side on the main film 1, with an intermediate gap between the reinforcement strips 5, 6, as shown in FIG. 1*b*. Therefore, the reinforcement strips 5 and 6 do not contact each other. They are only in contact with the main film 1.

The reinforcement strips 5 and 6 are positioned as close as possible to the corresponding columns 3 of holes 2, such that the reinforcement strips 5, 6 do not overlap or even contact the lips 4 around the holes 2.

In FIG. 1(*b*) (as well as in FIGS. 3 to 8) the lips 4 are shown as having the same thickness as the main film 1. However, as mentioned previously, the lips 4 may also have a thickness greater than that of the main film 1.

Figure 2:
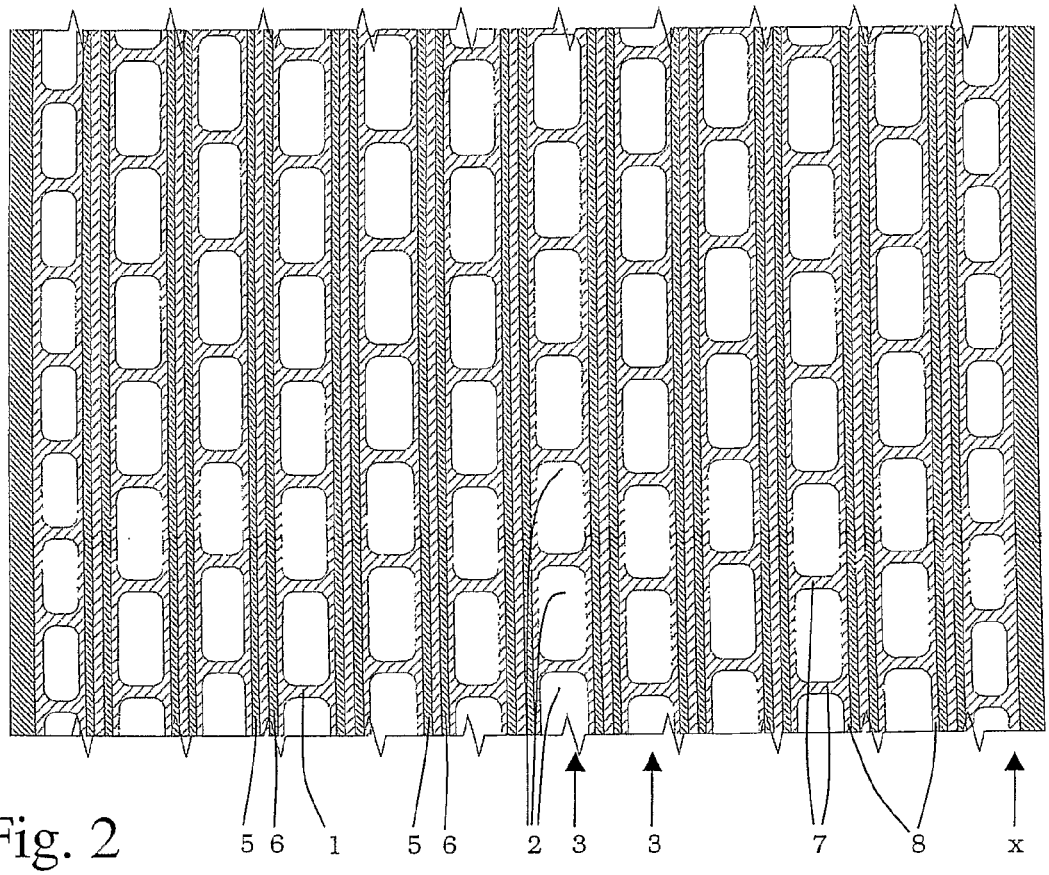
FIG. 2 shows the stretch film of FIG. 1 in a moderately stretched state.

FIG. 2 shows another possible embodiment of a packaging film according to the invention. The holes 2 are larger, in particular in the main direction X, while the bridges 7 are narrower. So-called main strips 8 which are also part of the main film 1 and on which the reinforcement strips 5, 6 extend are narrower transversely of the main direction X. It is also possible that the width of the reinforcement elements is narrower. Hence the main film 1 is formed by the main strips 8 extending in the main direction X and the bridges 7 extending transversely thereof, thereby providing a certain net-shaped structure.

Figure 3:
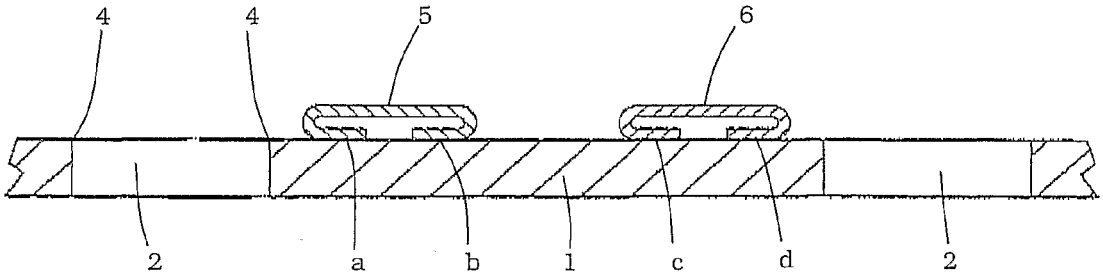
FIG. 3 is a cross-section through a second embodiment of the packaging film of the invention.

FIG. 3 is a cross-section through a second embodiment of the packaging film, in which each reinforcement strip 5, 6 has inwardly folded edges. Thus, the two reinforcement strips 5, 6 touch the main film 1 on four distinct points a, b, c, d (strip-like contacting zones).

Figure 4:
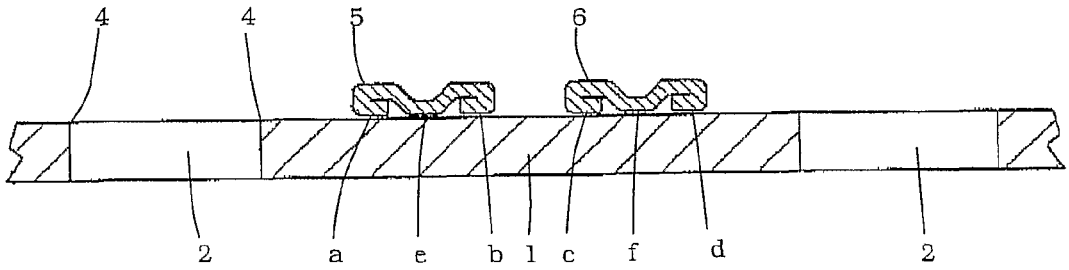
FIG. 4 shows a third embodiment of the packaging film of the invention.

FIG. 4 shows a cross-section through a third embodiment of the packaging film according to the invention. This embodiment is based on the second embodiment shown in FIG. 3, after lamination of which (e.g. by passing the product through a pair of nip rollers) the reinforcement strips touch the main film 1 on six distinct areas a, b, c, d, e, f.

Obviously, the same idea is applicable to the rest of the figures as well. Namely, after lamination, the gaps (which may appear in the figures for purposes of clear illustration) will disappear and the layers of reinforcement strips and/or the main film will be in contact with each other.

Figure 5:
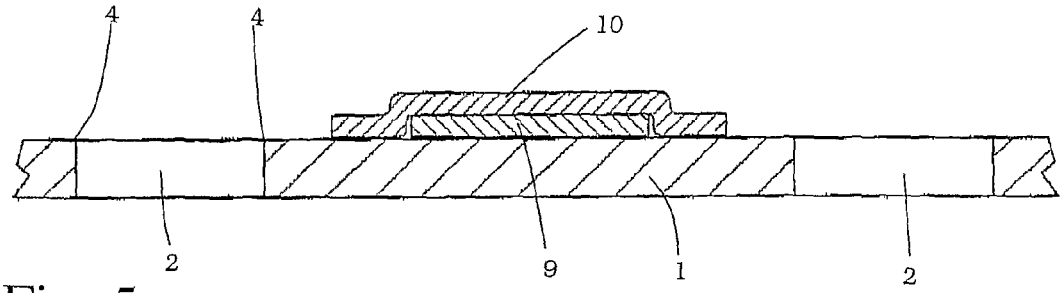
FIG. 5 shows a cross-section through a stretch film according to a fourth embodiment of the invention.

FIG. 5 shows a cross-section through a fourth embodiment of the invention. A first reinforcement strip 9 is placed on main film 1. The first reinforcement strip 9 is fully overlapped and covered by a second reinforcement strip 10 having a greater width than first reinforcement strip 9. Thus, both reinforcement strips 9, 10 are in contact with main film 1.

Figure 6:
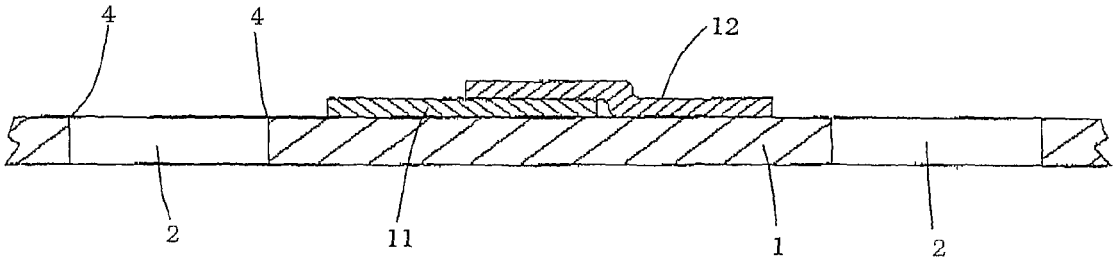
FIG. 6 shows a cross-section through a stretch film according to a fifth embodiment of the invention.

According to FIG. 6 showing a cross-section of a fifth embodiment of the invention, a first reinforcement strip 11 is arranged on main film 1. A second reinforcement strip 12 is placed on main film 1 and reinforcement strip 11 such that it partly overlaps reinforcement strip 11.

Figure 7:
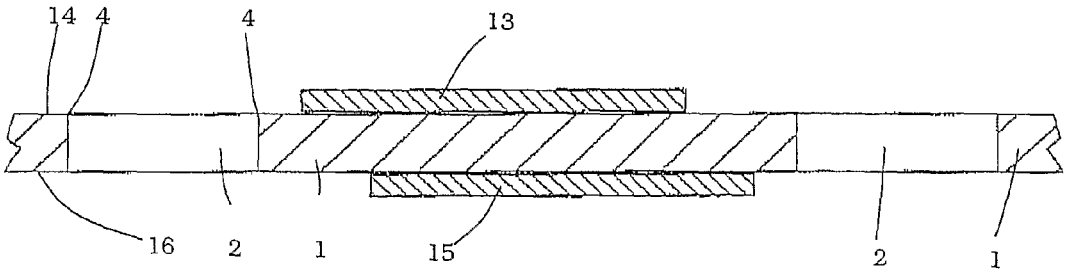
FIG. 7 shows a cross-section through a stretch film according to a sixth embodiment of the invention.

FIG. 7 shows a cross-section of a sixth embodiment of the invention. A first reinforcement strip 13 is arranged on a first surface 14 of main film 1 whereas a second reinforcement strip 15 is placed on the opposing second surface 16 of main film 1. It is possible that the vertical projections of reinforcement strips 13 and 15 do not coincide exactly so that reinforcement strips 13 and 15 are staggered or shifted as shown in FIG. 7.

Figure 8:
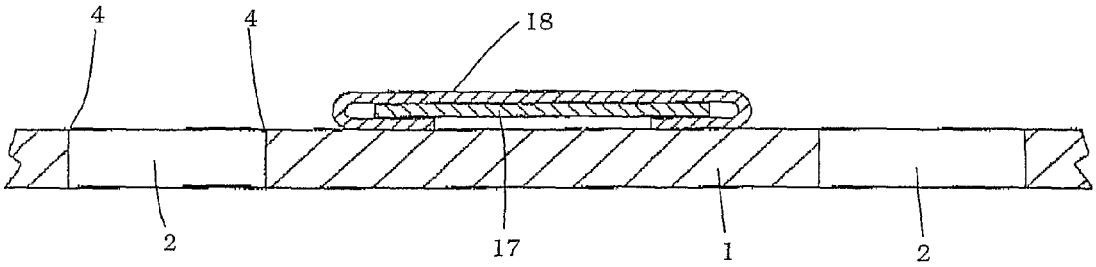
FIG. 8 shows a cross-section through a stretch film according to a seventh embodiment of the invention.

FIG. 8 shows a cross-section through a seventh embodiment of the packaging film according to the invention. A first reinforcement strip 17 is surrounded by a second reinforcement strip 18 having a greater width and having folded edges such that the edges of reinforcement strip 18 surround the first reinforcement strip 17. The edges of reinforcement strip 18 are in contact with main film 1. Further, in view of the overall width of reinforcement strips 17 and 18, also first reinforcement strip 17 will contact main film 1, even if this is not shown in FIG. 8 (especially after exerting pressure on the packaging film by laminating the film e.g. passing the film through a pair of nip rolls).

Figure 9:
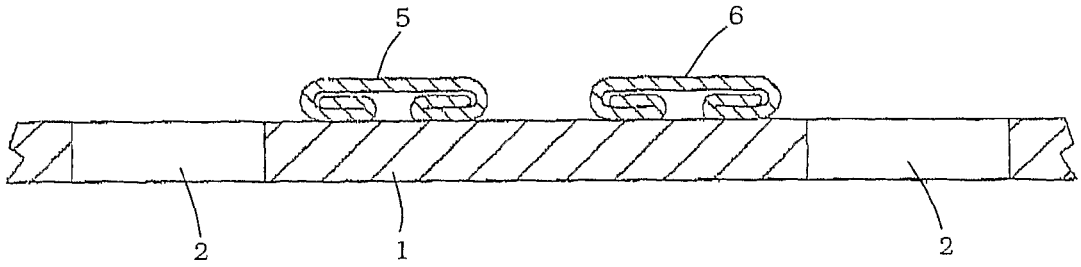
FIG. 9 shows a cross-section of another possible embodiment of the invention.

In FIG. 9 the possibility of the lateral edges being folded twice is illustrated. The double folding further reinforces the reinforcement strip 5, 6 against tearing. However, care should be taken so that the strip 5, 6 adheres well on the main film 1 and no wrinkles appear on the strip 5, 6. Moreover, in certain cases, it may not be advantageous to fold the strip 5, 6 more than once or twice, because the thickness profile of the resultant product will be very uneven.

FIGS. 10 to 13 show possible variations of a further embodiment of the invention in which the folded lateral edges 21 of a reinforcement strip 20 are in contact (overlap) with one another. In all cases, for each reinforcement element, a longitudinal region is formed in which three layers of the reinforcement strip 20 overlap. Thus, in such regions the reinforcement element has a thickness equal to three times the thickness of the original strip 20. Obviously, by continuing folding in this fashion, embodiments with four or more times the original strip 20 thickness can be achieved. However, in most cases, two or three times the original thickness is a good compromise between strengthening the strip 20 and maintaining a relatively even thickness profile.

Preferably, the reinforcement strip 20 is folded in such a way that an edge 21 of the reinforcement strip 20 always ends up in a secluded area and it is not exposed (i.e. it does not form part of the outer boundary of the reinforcement element 20). For example, in FIGS. 10 and 11 the edges 21 of the strip 20 are always under another strip layer. In contrast, in FIG. 13, the edge 21 of the strip 20 is exposed (i.e. forms part of the boundary of the reinforcement element 20).

Figure 12:
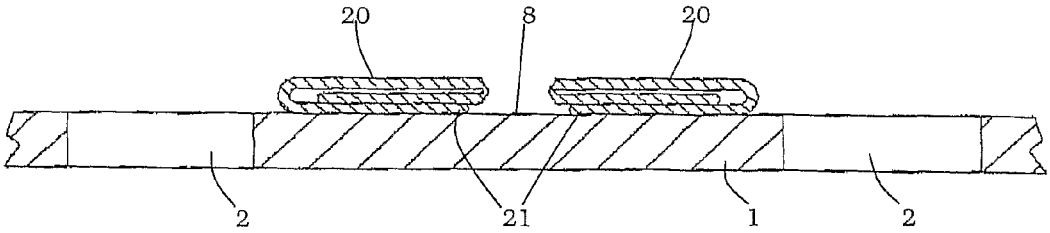
Figure 13:
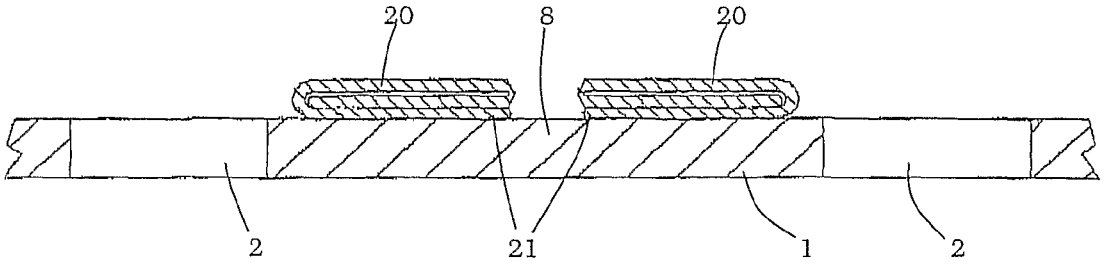

FIG. 12 shows a marginal situation in which the edge 21 of the reinforcement strip 20 may or may not constitute part of the boundary of the reinforcement element. Such a situation may occur, in practice, due to imperfections inherent to a production process. As shown in FIGS. 12 and 13, this problem can be partly resolved if the strip 20 is folded so that a possible exposed edge 21 will be facing inwards, (i.e. towards the centre of the main strip 8) rather than outwards (i.e. towards the holes 2).

Figure 10:
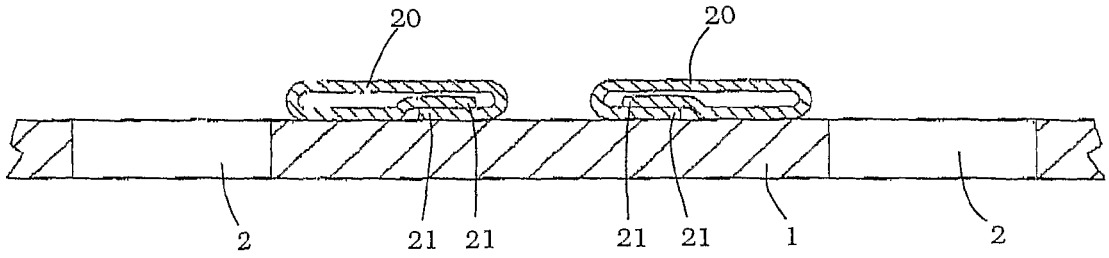
FIGS. 10 to 13 show cross-sections of various possible forms of other embodiments of the invention.
Figure 11:
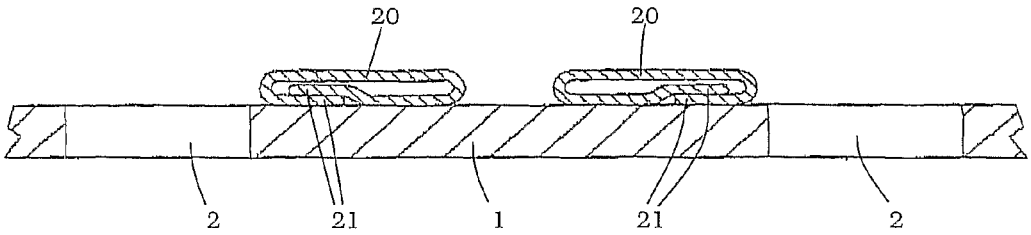

It has turned out that the embodiments of FIGS. 10 and 11 also lead to a reasonably stable production process, although all embodiments are equally possible.

Figure 14:
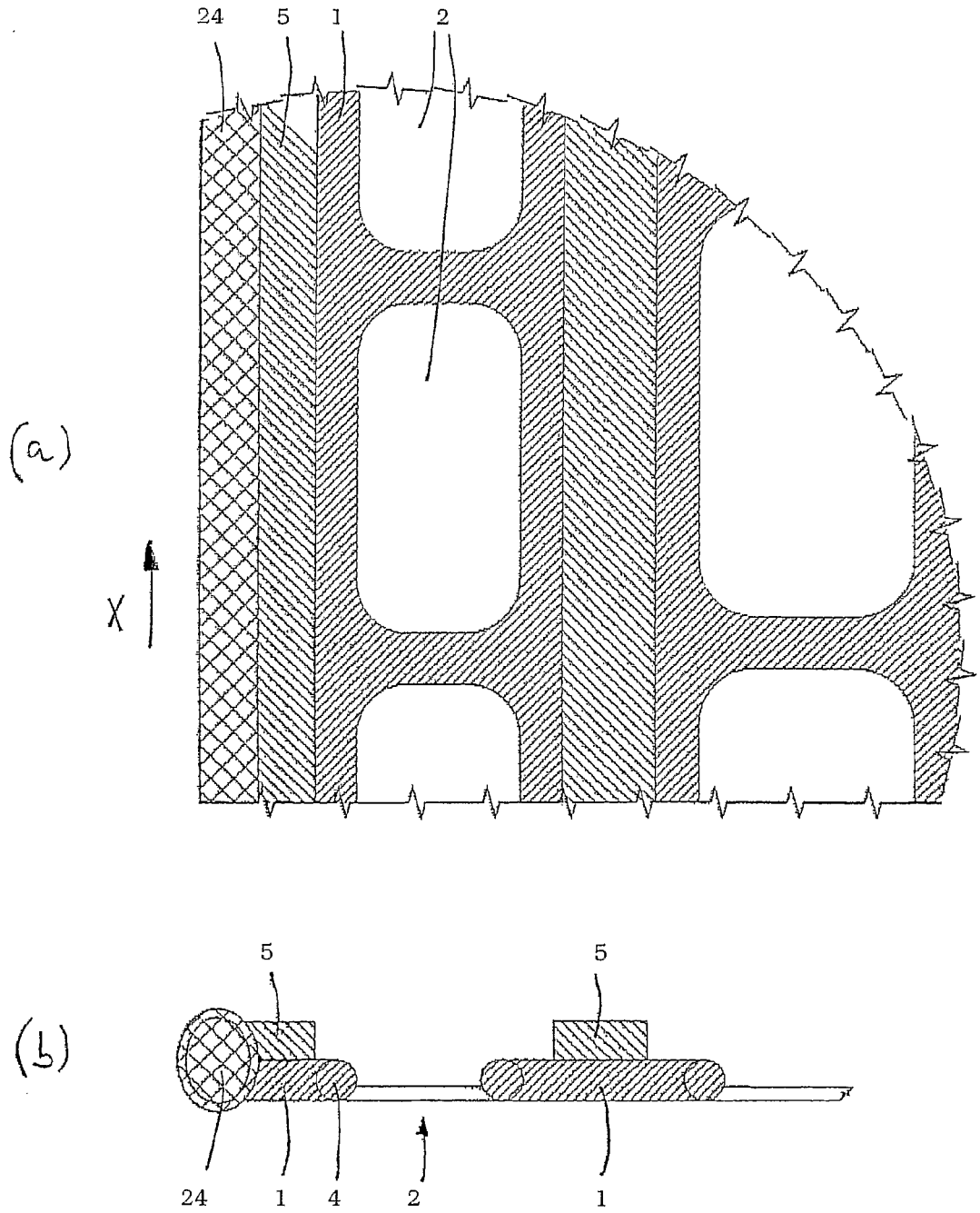
FIG. 14(*a*) shows a top view of a further embodiment of a lateral edge portion of a packaging film according to the invention.

FIG. 14 shows another embodiment of the invention wherein FIG. 14(*a*) is a top view and FIG. 14(*b*) is a cross-section.

A reinforcement strip 5 is fixed on base film 1. The margins of base film 1 and reinforcement strip 5 are hemmed, i.e. folded together forming a hemming zone 24.

Figure 15:
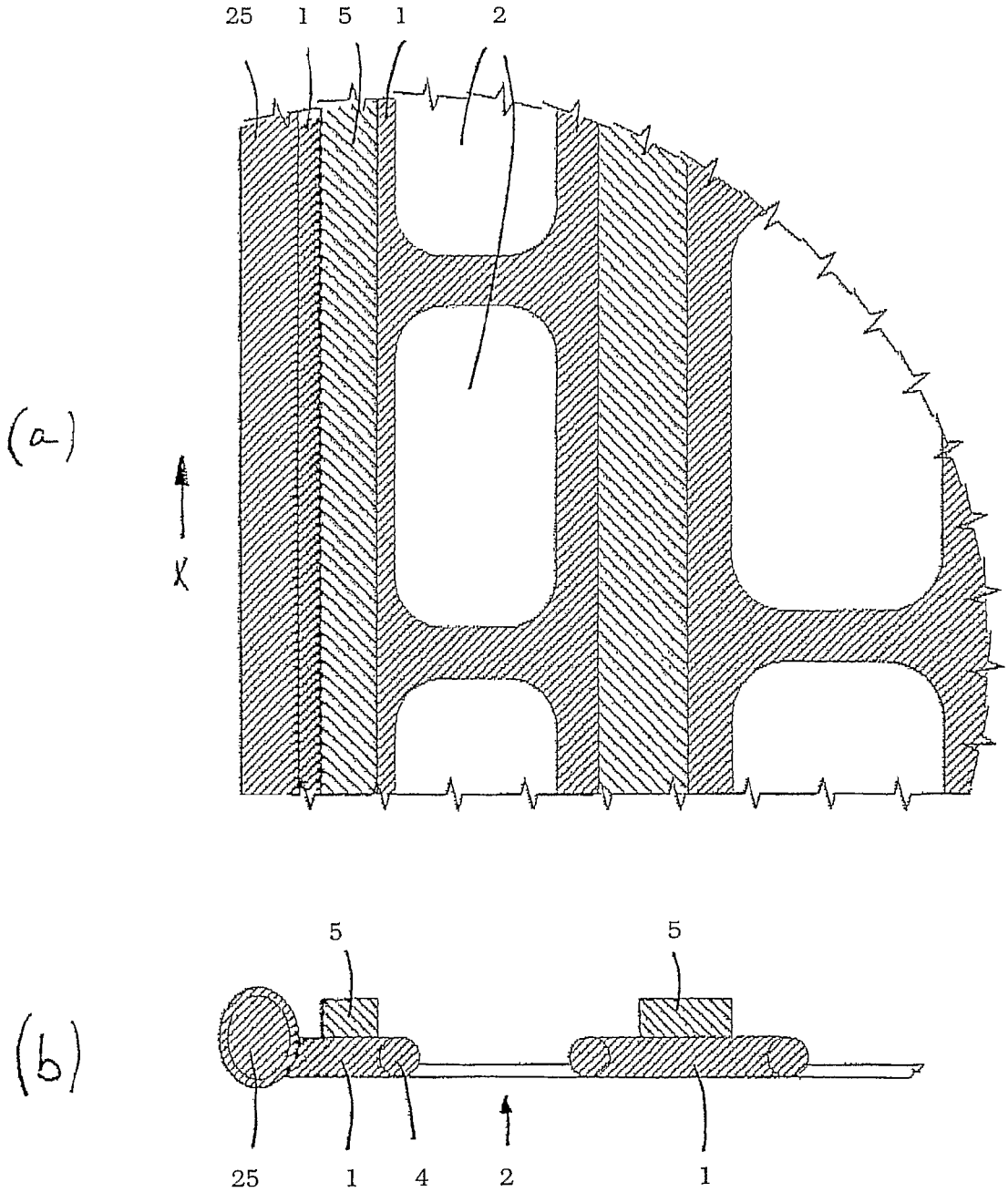
FIG. 15(*a*) a top view of a still further embodiment of a lateral edge portion of a packaging film according to the invention.
Figure 16:
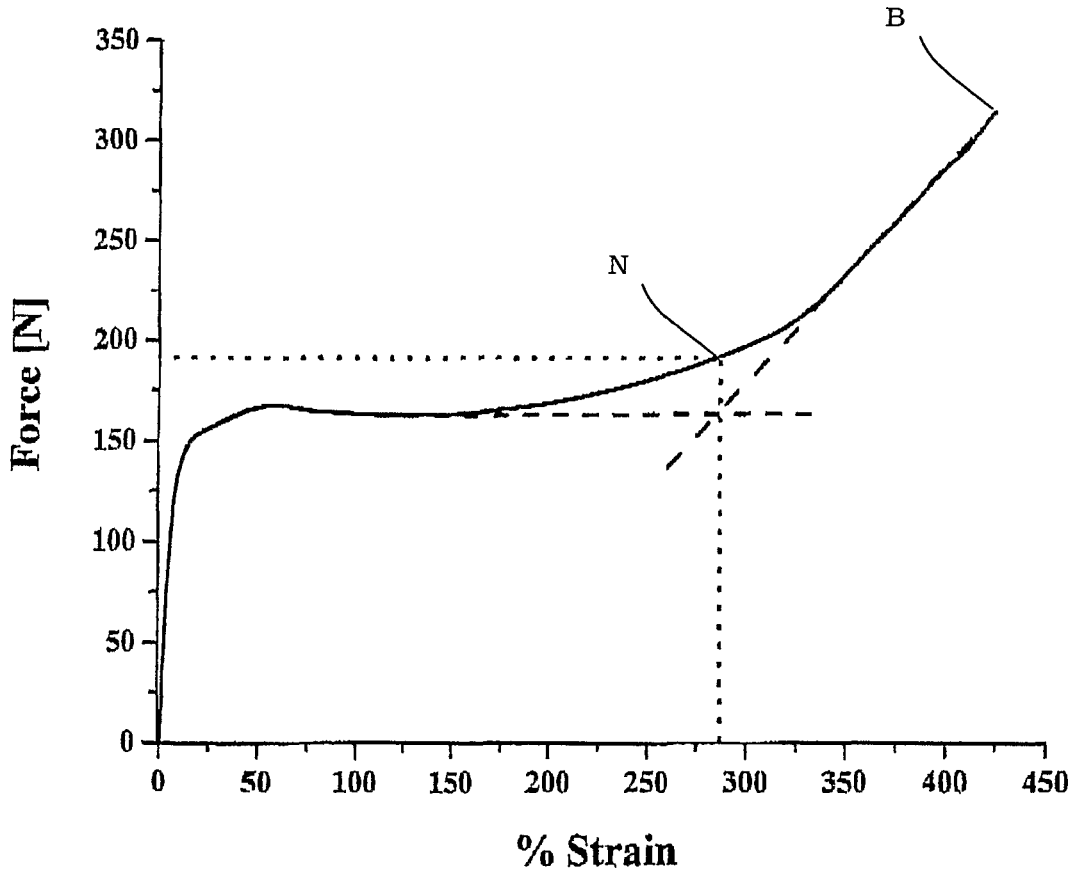
FIG. 16 a typical tensile stress-strain curve for explaining the Natural Draw Ratio point (NDR point).

FIG. 15 shows still another embodiment of the invention which is somewhat similar to FIG. 14. FIG. 15(*a*) is a top view and FIG. 15(*b*) is a cross-section of this embodiment.

The reinforcement strip 5 does not extend to the lateral edge of main film 1. Rather, as can be depicted from FIG. 15(*b*), the width of reinforcement strip 5 is dimensioned such that it does not reach the lateral edge of the main film 1. Only the lateral edge of main film 1—and not reinforcement strip 5—is hemmed for forming a hemming zone 25.

The hemming zone 24 shown in FIG. 14 consists of both, the main film 1 and the reinforcement strip 5, whereas the hemming zone 25 of FIG. 15 consists only of the main film 1.

It may be that the main film 1 (and the reinforcement strip 5 in FIG. 14) are folded for forming a smooth hemming zone 24, 25 without any wrinkles. It is also possible that the formation of the hemming zone 24, 25 results in a wrinkled and folded area.

Note that in both FIG. 14 as well as in FIG. 15 the reinforcement strip 5 is dimensioned and positioned so that it does not contact lip 4. Of course, in the general case reinforcement strip 5 can have any other form described herein.

It is obvious that other embodiments of the invention are also possible by combining ideas illustrated in the figures and explained in the above discussion. At least one reinforcement element may comprise two or more strips of stretchable polymer material or stretchable polymer film material.

For example, the strips 17, 18 of FIG. 8, can be viewed together as constituting one reinforcement element. In this case, between two adjacent columns of holes two such reinforcement elements should be placed. These may not be in contact with each other and at least a part of at least a surface of each one of them may be in direct contact with the main film 1.

Thus, in the general case, a reinforcement element of the invention may comprise one or more reinforcement strips. At least one edge of at least one reinforcement strip may be folded and the strips may partly or totally overlap and/or surround each other.

It is advantageous that the reinforcement elements or reinforcement strips contact the main film 1 smoothly without any wrinkles. Further, the folded or overlapping areas of a reinforcement strip should also be flat and smooth without wrinkles for improving the ability to introduce shear forces or shear tensions into the reinforcement strips.

In particular, it is advantageous if in the area of contact between a reinforcement element and the base film, an interfacial area is provided in which conditions have been met so that an interfacial polymer chain mixing has occurred. Thus, a strong interface is formed between the reinforcement element and the base film as a result of surface rearrangement, surface modification and subsequent molecular interdiffusion, intercrystallization and solidification. The interfacial area (diffusion area) ensures that the base film and the reinforcement element arranged thereon are inseparably joined together and will from then on act as one unit.

In the following Table 1 an example for a packaging film according to an embodiment of the present invention is compared to three example products according to prior art. All these packaging films have similar elongation at NDR point; therefore, in theory they are all suitable for use with a wrapping machine at a pre-stretch ratio between about 250% and 280%.

TABLE 1

| Product | Final Aeration at NDR (%) | Elongation at NDR (%) | Initial Weight (grams/m) | Final Weight NDR (grams/m) | Force at NDR (N) | Final Aeration/Final Weight (m/grams) |
|---|---|---|---|---|---|---|
| Inventive film 1 | 57 | 280 | 14.6 | 3.84 | 180 | 14.8 |
| Prior art 1 | 54 | 265 | 16.3 | 4.47 | 200 | 12.1 |
| Prior art 2 | 55 | 250 | 15.6 | 4.46 | 225 | 12.3 |
| Prior art 3 | 53 | 280 | 15.5 | 4.08 | 190 | 13.0 |

The stress-strain curve for the above and other measurements reported herein was obtained using a Zwick-Roell extensometer with grips of 21 cm width and a 2.5 kN load cell at room temperature. The pressure of the pneumatic system that closes the grips was 8 bars, the gap between the grips was 10 cm and the speed of the grips (cross-head speed) was set to 3 meters per minute. The width of the specimens was 16 cm and the results reported herein are normalized for the entire width of the packaging film.

As can be seen from Table 1, the packaging film according to the invention has a lower weight, similar aeration, lower force at the NDR point and superior final aeration over final weight ratio.

The inventive packaging film was manufactured using a 17 microns (50 cm wide) ATX type film of Manuli Stretch S.p.A. as a main film and a 30 microns (25 cm wide) ATX film of Manuli Stretch S.p.A. for the reinforcement strips. The average distance of a reinforcement strip from the edge of the adjacent holes is not greater than 3 mm. The average weight per meter of such a packaging film before any stretching is between about 13.8 and 14.7 grams per meter. Even at the higher end of that margin, inventive film 1 is lighter than all prior art films and can be stretched to an elongation at least equal to the elongation that prior art films can be stretched. Also its holding force at those elongations will be somewhat lower compared to prior art films, which is advantageous for protecting the goods wrapped by the packaging film.

Another example of the packaging film according to the invention (Inventive film 2) is shown in the following Table 2.

TABLE 2

| Product | Final Aeration at NDR (%) | Elongation at NDR (%) | Final Weight at NDR (grams/m) | Force at NDR (N) | Final Aeration/Final Weight (m/grains) |
|---|---|---|---|---|---|
| Inventive film 2 | 55 | 230 | 3.7 | 190 | 14.9 |
| Prior art 4 | 48 | 230 | 3.9 | 215 | 12.3 |
| Prior art 5 | 57 | 230 | 4.7 | 220 | 12.1 |

Such products could be suited for wrapping machines with a pre-stretch ratio of about 230%. Again it is evident that the inventive product has distinct, superior technical characteristics compared to the prior art products.

For another example, inventive film 3 shown in Table 3 below was manufactured using an ATX film of Manuli Stretch S.p.A. with 17 microns thickness and 50 cm width for the main film and an ATX film of Manuli Stretch S.p.A. of 23 microns thickness and 25 cm width for the reinforcement strips.

TABLE 3

| Product | Final Aeration at NDR (%) | Elongation at NDR (%) | Final Weight at NDR (grams/m) | Force at NDR (N) | Final Aeration/Final Weight (m/grams) |
|---|---|---|---|---|---|
| Inventive film 3 | 55 | 230 | 3.6 | 160 | 15.3 |

Such a product would be suitable to an application that does not require a very high strength, high holding force film, offering superior weight and aeration factors.

It should be noted that specially designed (i.e. non-standard) wrapping machines have been disclosed (for example EP 0 300 855, U.S. Pat. No. 4,235,062, U.S. Pat. No. 4,754,594). Such machines may pre-cut, fold or bunch the edges and then stretch a stretch film, thus reaching results that, at first, may seem similar to results achieved by the herein disclosed products. However, such methods have a major disadvantage compared to a packaging film according to the invention. They require modifications to an existing wrapping machine or even the purchasing of a new non-standard wrapping machine. Thus, they are not cost-effective. Also they can not be used with all types of pallets and wrapping processes and they are not compatible with all types of machines. Another disadvantage of such methods is that the load is effectively wrapped with several separate narrow bands of film rather than a network structure, thus leading to very poor performance along transverse directions and at the corners of the pallet and the load. Instead by just purchasing a packaging film according to the invention disclosed hereby, the end-users can still work with their existing, standard wrapping machines and no mechanical modifications are necessary. It is also possible to alternate (e.g. in the course of a working day or week) between stretch film and the inventive product as required by the specific goods to be palletized.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

The invention claimed is:

1. A packaging film, comprising a main film made of a stretchable polymer film material and having a main direction; and a multiplicity of holes on the main film; wherein the holes on the main film are arranged in at least three substantially parallel columns along the main direction;

the columns of holes are staggered with respect to the main direction such that a center of one hole in one column is on a different line transverse to the main direction than the centers of adjacent holes in the immediately adjacent columns;

the main film is made of structural polyethylene films material or copolymers thereof;

a ratio of aeration percentage over final weight of the packaging film is greater than or equal to 14 meters per gram;

the aeration percentage is calculated for a predetermined length of the packaging film as the total area covered by the holes over the total area of the packaging film including the area of the holes, when the packaging film is stretched along a main direction to an elongation equal to the elongation at the Natural Draw Ratio point (NDR point), wherein the predetermined length is greater than or equal to about 0.3 meters;

the final weight is the weight of the packaging film per said film meter measured in grams per meter, when the packaging film is stretched along a main direction at an elongation equal to the elongation at the Natural Draw Ratio point (NDR point);

an initial width of the packaging film is reducible by less than 15% between a condition before any stretching of the packaging film and a condition when the packaging film is stretched along a main direction at an elongation equal to the elongation at the Natural Draw Ratio point (NDR point);

a ratio of an absolute value of the difference of a predetermined target holding force of the packaging film minus a holding force divided by the predetermined target holding force is less than or equal to 5%, wherein the predetermined target holding force is greater than or equal to 70 Newtons and less than or equal to 380 Newtons, and wherein the holding force of the packaging film is determined as the tensile force at the Natural Draw Ratio point (NDR point); and a ratio of an elongation at break of the packaging film measured along a transverse direction to the main direction over the elongation at the Natural Draw Ratio point (NDR point) is greater than or equal to 50%.

2. The packaging film according to claim 1, wherein the ratio of aeration percentage over final weight of the packaging film is greater than or equal to 15 meters per gram.

3. The packaging film according to claim 1, wherein the initial width of the packaging film is reducible by less than 12% between a condition before any stretching of the packaging film and a condition when the packaging film is stretched along a main direction at an elongation equal to the elongation at the Natural Draw Ratio point (NDR point).

4. The packaging film according to claim 1, wherein the ratio of an absolute value of the difference of a predetermined target holding force of the packaging film minus a holding force divided by the predetermined target holding force is less than or equal to 3%, and wherein the holding force of the packaging film is determined as the tensile force at the Natural Draw Ratio point (NDR point).

5. The packaging film according to claim 1, wherein the ratio of elongation at break of the packaging film measured along a transverse direction to the main direction over the elongation at the Natural Draw Ratio point (NDR point) is greater than or equal to 60%.

6. The packaging film according to claim 1, wherein the initial width of the film is no less than 40 cm and no more than 55 cm; and the predetermined target holding force is greater than or equal to 70 Newtons and less than or equal to 250 Newtons.

7. The packaging film according to claim 1, wherein the initial width of the film is no less than 55 cm and no more than 80 cm; and the predetermined target holding force is greater than or equal to 100 Newtons and less than or equal to 380 Newtons.

8. The packaging film according to claim 1, wherein at least one reinforcement element is arranged and fixed on the main film along the main direction.

9. The packaging film according to claim 8, wherein the at least one reinforcement element comprises at least one reinforcement strip made of a stretchable polymer film material.

10. The packaging film according to claim 8, wherein the at least one reinforcement element is fixed on the main film in an area between two adjacent columns of holes.

11. The packaging film according to claim 8, further comprising a plurality of reinforcement elements, wherein the reinforcement elements are arranged on a selected one of the same surface of the main film or on different, opposing surfaces of the main film.

12. The packaging film according to claim 11, wherein at least two reinforcement elements are fixed on the main film in an area between two adjacent columns of holes.

13. The packaging film according to claim 12, wherein at least a part of a surface of each of the at least two reinforcement elements is in direct contact with the main film.

14. The packaging film according to claim 8, wherein at least one edge of the at least one reinforcement elements is selected from the group consisting of hemmed, bunched and folded longitudinally.

15. The packaging film according to claim 12, wherein the at least one reinforcement element is arranged in an area between the two adjacent columns of holes where the at least two reinforcement elements are not arranged.

16. The packaging film according to claim 12, wherein no reinforcement element is arranged in an area between the two adjacent columns of holes, where the at least two or the at least one reinforcement elements are not arranged.

17. The packaging film according to claim 12, wherein the at least two reinforcement elements between the two adjacent columns of holes are not in direct contact with each other.

18. The packaging film according to claim 12, wherein the at least two reinforcement elements between the two adjacent columns of holes are at least partly overlapping each other.

19. The packaging film according to claim 12, wherein exactly two reinforcement elements are arranged between the two adjacent columns of holes.

20. The packaging film according to claim 8, wherein the at least one reinforcement element is arranged between a lateral edge of the main film and an adjacent columns of holes.

21. The packaging film according to claim 18, wherein one of the at least two reinforcement elements between the two adjacent columns of holes is completely overlapping the other reinforcement element.

22. The packaging film according to claim 21, wherein lateral edges of the one reinforcement element which is completely overlapping the other reinforcement element are folded such that the folded edges are partly surrounding the other reinforcement element.

23. The packaging film according to claim 8, wherein at least one lateral edge of the at least one reinforcement element is folded inwardly at least once; and the at least one reinforcement element is arranged on the main film such that the folded lateral edges are in contact with the main film.

24. The packaging film according to claim 23, wherein both lateral edges of the at least one reinforcement elements are folded inwardly; and the at least one reinforcement element is arranged on the main film such that the folded lateral edges are in contact with the main film.

25. The packaging film according to claim 8, wherein both lateral edges of the at least one reinforcement element are folded such that they overlap with one another at least once, to create a longitudinal region of the at least one reinforcement element that has at least three times the original thickness of the at least one reinforcement element.

26. The packaging film according to claim 8, wherein the at least one reinforcement element is arranged to minimize a distance between an edge of the at least one reinforcement element and an adjacent edge of a hole in the multiplicity of holes.

27. The packaging film according to claim 26, wherein the distance is smaller than or equal to 5 mm.

28. The packaging film according to claim 1, wherein the holes are formed by a thermal irradiation method without contacting the main film.

29. The packaging film according to claim 28, wherein each hole is surrounded by a lip formed by accumulated polymer material of the main film and having a thickness greater than the thickness of the main film.

30. The packaging film according to claim 29, wherein at least one reinforcement element is arranged and fixed on the main film along the main direction and wherein the at least one reinforcement element is arranged such that it is not in contact with the lips surrounding the holes or with edges of the holes.

31. The packaging film according to claim 30, wherein the at least one reinforcement element is arranged to minimize a distance between an edge of the at least one reinforcement element and an adjacent lip.

32. The packaging film according to claim 31, wherein the distance is smaller than or equal to 5 mm.

33. The packaging film according to claim 8, wherein the thickness of the at least one reinforcement element is greater than or equal to twice the thickness of the main film.

34. The packaging film according to claim 8, wherein the surface of the at least one reinforcement element is substantially smooth and has no wrinkles.

35. The packaging film according to claim 8, wherein the at least one reinforcement elements and/or the main film are heated before attaching the at least one reinforcement elements on to the main film.

36. The packaging film according to claim 8, wherein an interfacial area in which polymer chains of the main film mix with polymer chains of the at least one reinforcement element is provided in the area of contact between the at least one reinforcement element and the main film.

37. The packaging film according to claim 1, wherein the aeration percentage is greater than or equal to 40% when the packaging film is stretched along a main direction to an elongation equal to the elongation at the Natural Draw Ratio point (NDR point).

38. The packaging film according to claim 1, wherein the final weight is smaller than or equal to 3.9 grams per meter when the packaging film is stretched along the main direction to an elongation equal to the elongation at the Natural Draw Ratio point (NDR point).

39. The packaging film according to claim 1, wherein the elongation at the Natural Draw Ratio point (NDR point) is in between 30% and 400%.

40. The packaging film according to claim 1, wherein the elongation at break of the packaging film measured along a transverse direction to the main direction is at least 80%.

41. The packaging film according to claim 1, wherein the initial width of the packaging film is no less than 42 cm and no more than 51 cm.

42. Use of a packaging film according to claim 1 for wrapping a load formed by goods stacked on a selected one of a pallet or a trolley or another form of load with the aid of a wrapping machine or by manual application of the film to the load.

43. The packaging film according to claim 2, wherein the ratio of aeration percentage over final weight is greater than or equal to 16 meters per gram.

44. The packaging film according to claim 3, wherein the initial width of the packaging film is reducible by less than 10%, between a condition before any stretching of the packaging film and a condition when the packaging film is stretched along a main direction at an elongation equal to the elongation at the Natural Draw Ratio point (NDR point).

45. The packaging film according to claim 4, wherein the ratio of an absolute value of the difference of a predetermined target holding force of the packaging film minus a holding force divided by the predetermined target holding force is less than or equal to 1%, wherein the holding force of the packaging film is determined as the tensile force at the Natural Draw Ratio point (NDR point).

46. The packaging film according to claim 5, wherein the ratio of an elongation at break of the packaging film measured along a transverse direction being transverse to the main direction over the elongation at the Natural Draw Ratio point (NDR point) is greater than or equal to 70%.

47. The packaging film according to claim 46, wherein the ratio of an elongation at break of the packaging film measured along a transverse direction being transverse to the main direction over the elongation at the Natural Draw Ratio point (NDR point) is greater than or equal to 80%.

48. The packaging film according to claim 6, wherein the predetermined target holding force is greater than or equal to 100 Newtons and less than or equal to 210 Newtons.

49. The packaging film according to claim 48, wherein the predetermined target holding force is greater than or equal to 150 Newtons and less than or equal to 190 Newtons.

50. The packaging film according to claim 7, wherein the predetermined target holding force is greater than or equal to 150 Newtons and less than or equal to 315 Newtons.

51. The packaging film according to claim 50, wherein the predetermined target holding force is greater than or equal to 220 Newtons and less than or equal to 285 Newtons.

52. The packaging film according to claim 27, wherein the distance is smaller than or equal to 3 mm.

53. The packaging film according to claim 52, wherein the distance is smaller than or equal to 1 mm.

54. The packaging film according to claim 32, wherein the distance is smaller than or equal to 3 mm.

55. The packaging film according to claim 54, wherein the distance is smaller than or equal to 1 mm.

56. The packaging film according to claim 33, wherein the thickness of the at least one reinforcement element is greater than or equal to three times the thickness of the main film.

57. The packaging film according to claim 37, wherein the aeration percentage is greater than or equal to 50%, when the packaging film is stretched along a main direction to an elongation equal to the elongation at the Natural Draw Ratio point (NDR point).

58. The packaging film according to claim 57, wherein the aeration percentage is greater than or equal to 60%, when the packaging film is stretched along a main direction to an elongation equal to the elongation at the Natural Draw Ratio point (NDR point).

59. The packaging film according to claim 38, wherein the final weight is smaller than or equal to 3.8 grams per meter, when the packaging film is stretched along the main direction to an elongation equal to the elongation at the Natural Draw Ratio point (NDR point).

60. The packaging film according to claim 59, wherein the final weight is smaller than or equal to 3.7 grams per meter when the packaging film is stretched along a the main direction to an elongation equal to the elongation at the Natural Draw Ratio point (NDR point).

61. The packaging film according to claim 39, wherein the elongation at the Natural Draw Ratio point (NDR point) is in between 100% and 350%.

62. The packaging film according to claim 61, wherein the elongation at the Natural Draw Ratio point (NDR point), is in between 150% and 300%.

63. The packaging film according to claim 40, wherein the elongation at break of the packaging film measured along the transverse direction to the main direction is at least 120%.

64. The packaging film according to claim 63, wherein the elongation at break of the packaging film measured along the transverse direction to the main direction is at least 200%.

65. The packaging film according to claim 41, wherein the initial width of the packaging film is no less than 44 cm and no more than 50 cm.

66. The packaging film according to claim 40, wherein the initial width of the packaging film is no less than 62 cm and no more than 76 cm.

67. The packaging film according to claim 66, wherein the initial width of the packaging film is no less than 66 cm and no more than 75 cm.

* * * * *